US008029160B2

(12) United States Patent
Kuo et al.

(10) Patent No.: US 8,029,160 B2
(45) Date of Patent: Oct. 4, 2011

(54) ILLUMINATION DEVICE HAVING BI-CONVEX LENS ASSEMBLY AND COAXIAL CONCAVE REFLECTOR

(75) Inventors: Wu-Cheng Kuo, Tainan (TW); Ya-Hui Chiang, Taoyuan County (TW); Bing-Ru Chen, Pingtung County (TW); Hung-Lieh Hu, Hsinchu (TW); Kuo-Hsiang Chen, Taipei County (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 11/562,949

(22) Filed: Nov. 22, 2006

(65) Prior Publication Data

US 2008/0074879 A1 Mar. 27, 2008

(30) Foreign Application Priority Data

Sep. 27, 2006 (TW) ..... 95135748 A

(51) Int. Cl.
*F21V 5/04* (2006.01)
*F21V 7/04* (2006.01)

(52) U.S. Cl. ..... 362/268; 362/299; 362/308; 362/310; 362/331; 362/521

(58) Field of Classification Search ..... 362/268, 362/308, 331–332, 521, 296, 299, 310, 335, 362/326–329; 353/98, 102; 359/208, 362
See application file for complete search history.

(56) References Cited

U.S. PATENT DOCUMENTS

| | | | | |
|---|---|---|---|---|
| 308,870 | A * | 12/1884 | Boyle | 362/268 |
| 1,433,292 | A * | 10/1922 | Billman et al. | 362/309 |
| 3,633,022 | A * | 1/1972 | Sassmanshausen | 362/327 |
| 4,327,972 | A * | 5/1982 | Brunsting | 362/335 |
| 4,361,863 | A * | 11/1982 | Hagner | 362/551 |
| 5,103,381 | A | 4/1992 | Uke | |
| 5,788,366 | A * | 8/1998 | Rabl et al. | 362/347 |
| 6,338,568 | B1 | 1/2002 | Futami | |
| 6,558,032 | B2 | 5/2003 | Kondo et al. | |
| 6,575,580 | B2 * | 6/2003 | Okamori et al. | 353/98 |
| 7,052,139 | B2 * | 5/2006 | Akiyama | 353/38 |
| 2002/0008972 | A1 * | 1/2002 | Dewald | 362/268 |
| 2002/0176255 | A1 * | 11/2002 | Yamauchi et al. | 362/299 |
| 2005/0013132 | A1 * | 1/2005 | Kim et al. | 362/231 |

FOREIGN PATENT DOCUMENTS

| | | |
|---|---|---|
| CN | 2744929 Y | 12/2005 |
| JP | 2006-86062 | 3/2006 |
| TW | 403176 | 8/2000 |
| TW | I231402 | 4/2005 |
| TW | I261097 | 9/2006 |

OTHER PUBLICATIONS

Edward H. Stupp et al, "Projection Displays," 1998, pp. 186-195, John Wiley & Sons, USA.

* cited by examiner

*Primary Examiner* — Ismael Negron

(57) ABSTRACT

An illumination device includes a light source positioned on an illumination axis, a lens assembly having at least two biconvex lenses disposed on the illumination axis, and a reflector having a reflecting surface enclosing the lens assembly. The light source emits a first group of light beams which directly impinge of the lens assembly, and a second group of light beams which directly impinge on the reflector. The second group of light beams being reflected by the reflecting surface such that they surround the first group of light beams after being refracted by the lens assembly, without such second group of light beams impinging on the lens assembly.

14 Claims, 11 Drawing Sheets

ILLUMINATION DEVICE HAVING BI-CONVEX LENS ASSEMBLY AND COAXIAL CONCAVE REFLECTOR

BACKGROUND OF THE INVENTION

1. Field of the Invention

The invention relates to a projection illumination device, and in more particular to a projection illumination device utilizing a lens assembly and a reflector to project light beams.

2. Description of the Related Art

U.S. Pat. No. 6,558,032 discloses a LED lighting equipment for vehicle. In FIG. 1, the LED lighting equipment comprises a LED lighting equipment 1' comprising a LED lamp 2', a reflection surface of hyperboloid 4' having two focuses f1 and f2, and a reflection surface of paraboloid of revolution 5'. Light beams reflected by the reflection surface 4' are emitted outwardly and centrally from the focus f2. The focus f2 of the reflection surface 4' and the focus of the reflection surface 5' are overlapped. The light beams reflected by the reflection surface 5' travel to the remote ahead of the reflection surface 5'.

BRIEF SUMMARY OF THE INVENTION

The invention provides a projection illumination device capable of emitting light in a projecting mode such as distant-light mode. The projection illumination device of the invention comprises a light source, a lens assembly and a reflector. The light source generates a plurality of initial light beams. The initial light beams comprise a first reference light beam traveling in a first direction directed from the light source to the lens assembly and a second reference light beam traveling in a second direction directed from the light source to the reflector. The lens assembly is disposed on an axis. The first reference light beam traveling in the first direction passes through the lens assembly to form a first predetermined light beam traveling away from the light source and a first angle is substantially formed between the first direction and the axis. The reflector comprises a reflective surface. The second reference light beam traveling in the second direction is reflected by the reflecting surface of the reflector to form a second predetermined light beam traveling away from the light source. A second angle is formed substantially between the second direction and the first direction. The first angle is less than or equal to the second angle. The initial light beams are guided by the lens assembly and the reflector to emit light in the projecting mode.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
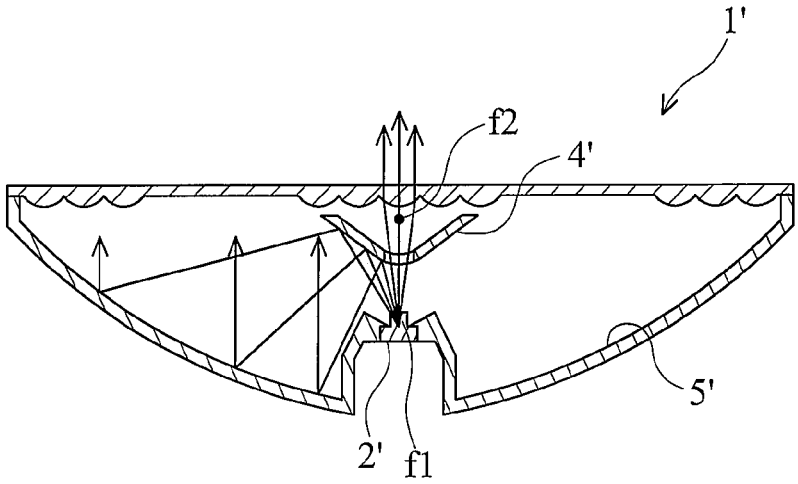
FIG. 1 (PRIOR ART)
FIG. 1 is a schematic view of a conventional vehicle light.
Figure 2A:
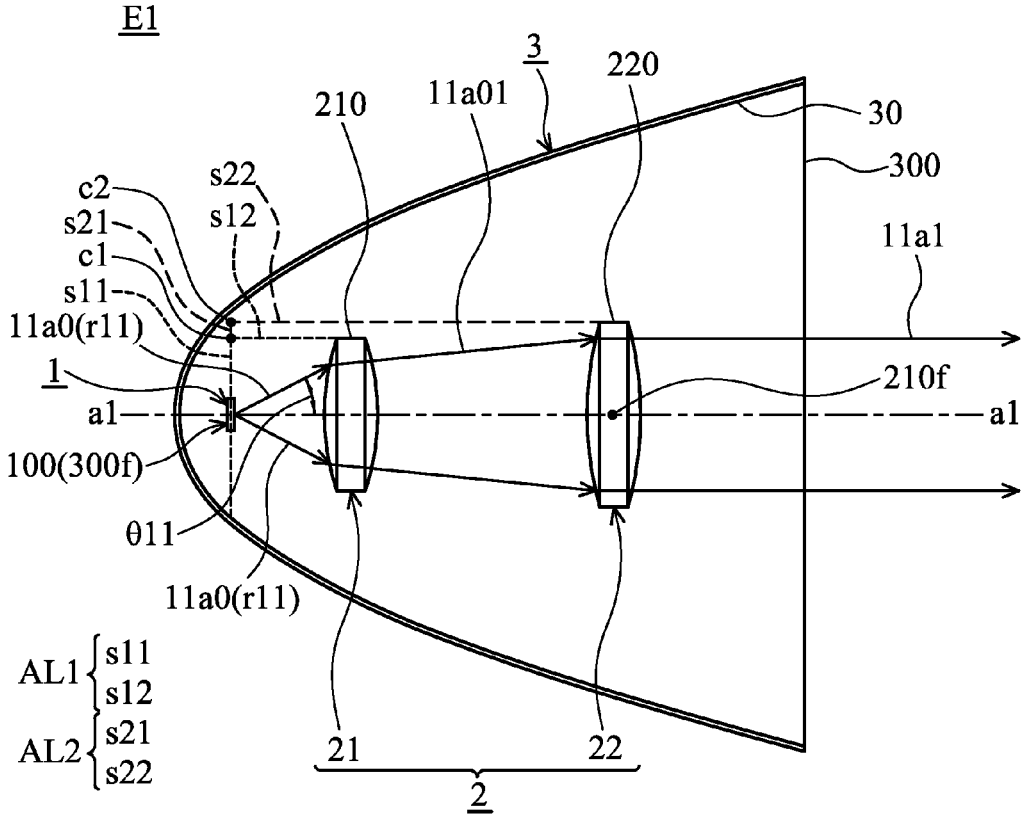
FIG. 2A is a schematic view of a projection illumination device (E1) of a first embodiment of the invention, wherein the projection illumination device (E1) is in an operating mode.

In FIG. 2A, a projection illumination device E1 of a first embodiment of the invention situated in an operating mode comprises a light source 1 provided with longitudinal profile, a lens assembly 2 and a reflector 3. The light source 1 and the lens assembly 2 disposed in the reflector 3 are spaced apart from each other. A plurality of initial light beams directly radiating from a radiating point 100 of the light source 1 are guided by the lens assembly 2 and the reflector 3 to form a desired projecting mode, e.g. distant-light mode, or other regulated light source distribution.

The reflector 3 comprises a light-emitting opening 300 and a conical continuous reflective surface 30 having a main focus 300*f* located at an axis a1-a1. The light source 1 enclosed by the reflector 3 therein and transversely crossing the axis a1-a1 at the radiating point 100 is located at the main focus 300*f* of the continuous reflective surface 30 of the reflector 3, and the shape of the light-emitting opening 300 is dependent on the curvature of the continuous reflective surface 30. In this embodiment, the longitudinal profile of the light source 1 is perpendicularly transverse to the axis a1-a1, the main focus 300*f* of the conical continuous reflective surface 30 of the reflector 3 and the radiating point 100 of the light source 1 are overlapped or actually the same one, and the continuous reflective surface 30 is a parabolic surface and the light-emitting opening 300 is symmetrical. The continuous reflective surface 30 can be an elliptical or hyperbolic surface.

The lens assembly 2 comprises a first lens unit 21 and a second lens unit 22 enclosed by the reflector 3 therein. The first lens unit 21 has a front convex side 210*c*, a first outer end 210 and a first focus 210*f*. The second lens unit 22 substantially located at the first focus 210*f* of the first lens unit 21 has a second outer end 220. The first and second lens units 21 and 22 disposed on the axis a1-a1 are spaced from each other, and the first lens unit 21 is located between the light source 1 and the second lens unit 22. The first lens unit 21 and the second lens unit 22 sequentially guide the initial light beams 11*a*0 directly radiating from the radiating point 100 of the light source 1 to form a first predetermined light beam 11*a*1 traveling away from the light source 1. That is, the front convex side 210*c* of the first lens unit 21 is a back side opposite to the second lens unit 22, and the continuous reflective surface 30 of the reflector 3 is concave to the front convex side 210*c* of the lens assembly 2. Two vertical assist lines AL1 and AL2 are utilized to geometrically define the light source 1 and the lens assembly 2. The vertical assist line AL1 is composed of a first line segment s11 and a second line segment s12 vertically intersected with the first line segment s11 at a corner point c1, and the vertical assist line AL2 is composed of a first line segment s21 and a second line segment s22 vertically intersected with the first line segment s21 at a corner point c2. With respect to the vertical assist line AL1, the first line segment s11 is perpendicular to the axis a1-a1 and passes through the light source 1, and the second line segment s12 is parallel to the axis a1-a1 and tangent to an outermost end (first outer end 210) of the first lens unit 21 of the lens assembly 2 with respect to the axis a1-a1. With respect to the vertical assist line AL2, the first line segment s21 is perpendicular to the axis a1-a1 and passes through the light source 1, and the second line segment s22 is parallel to the axis a1-a1 and tangent to an outermost end (second outer end 220) of the second lens unit 22 of the lens assembly 2 with respect to the axis a1-a1. Note that the corner point c1 of the vertical assist line AL1 and the corner point c2 of the vertical assist line AL2 are located within the reflector 3.

With respect to an effective area of the first lens unit 21, a conical initial light beams 11*a*0 directly radiating from the radiating point 100 of the light source 1 received by the first lens unit 21 are guided to the second lens unit 22. The outer conical surface of the conical initial light beams 11*a*0 is defined as a first position r11, and a first angle θ11 is substantially formed between the first position r11 and the axis a1-a1 with respect to the radiating point 100 of the light source 1. The initial light beams 11*a*0 located on the first position r11 are defined as a first reference light beam 11*a*0(*r*11) traveling in a first direction d11 directed from the light source 1 to the first lens unit 21 of the lens assembly 3. That is to say, the first angle θ11 is a first boundary effective angle θm1 (shown in FIG. 3) for the lens assembly 2 capable of guiding the initial light beams 11*a*0 directly radiating from the radiating point 100 of the light source 1 with respect to the axis a1-a1.

The initial light beams 11*a*0 located inside the first position r11 and the first reference light beam 11*a*0(*r*11) located on the first position r11, i.e., the initial light beams 11*a*0 located in the range of the first angle θ11 with respect to the axis a1-a1, are converted into a plurality of refracted light beams 11*a*01 by the first lens unit 21, and the refracted light beams 11*a*01 guided by the second lens unit 22 forms the first predetermined light beam 11*a*1 traveling away from the light source 1.

Figure 2B:
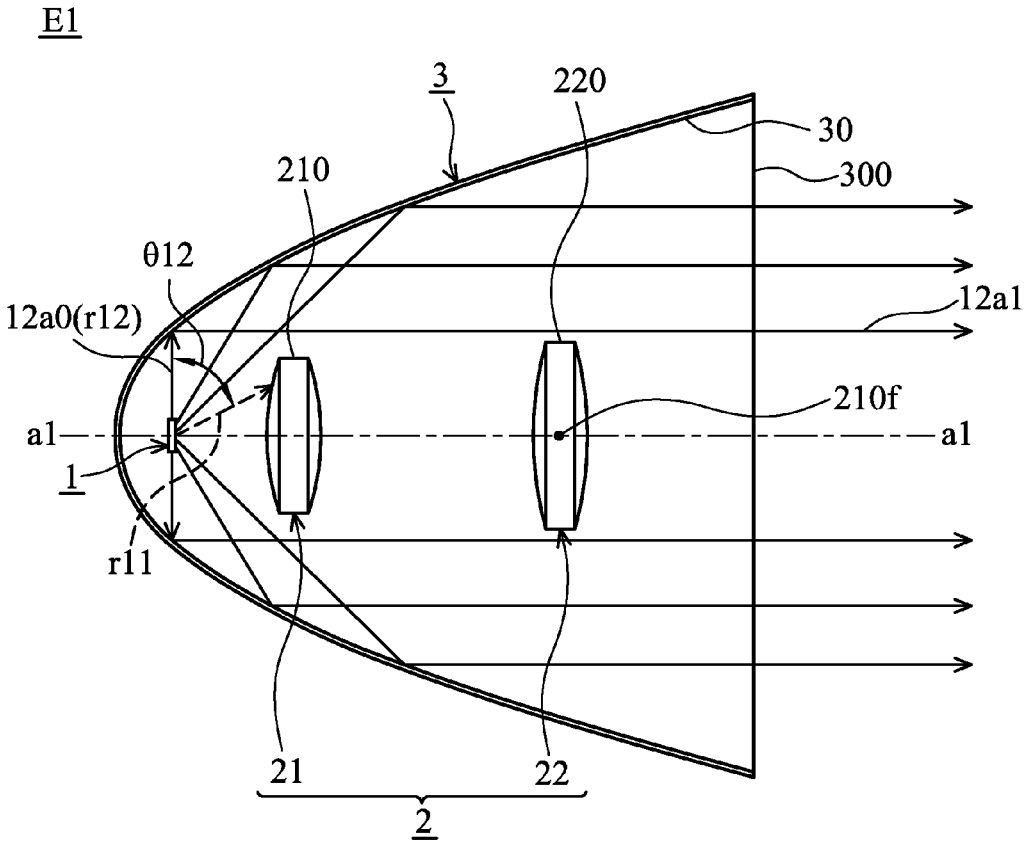
FIG. 2B is a schematic view of the projection illumination device (E1) in an operating mode.

In FIG. 2B, to specify the distribution of the light beams reflected by the continuous reflective surface 30 of the reflector 3, the initial light beams 11*a*0 located within the first position r11 guided by the first and second lens units 21 and 22 of the lens assembly 2 and the first predetermined light beam 11*a*1 formed by the first and second lens units 21 and 22 are omitted.

The initial light beams 12*a*0 directly radiating from the radiating point 100 of the light source 1 perpendicular to the axis a1-a1 is reflected by the continuous reflective surface 30 of the reflector 3 to form a second predetermined light beam 12*a*1 traveling away from the light source 1. The second predetermined light beam 12*a*1 substantially has a round structure defined as a second position or an effective position r12 which is perpendicularly intersected with the axis a1-a1 by passing through the site of the light source 1, i.e., the light source 1 is located at the intersection of the effective position r12 and the axis a1-a1, and a second angle θ12 is substantially formed between the second position r12 and the first position r11. The initial light beams 12*a*0 located on the second position r12 are defined as a second reference light beam 12*a*0 (*r*12) traveling on the second position r12. In this embodiment, the first angle θ11 is less than or equal to the second angle θ12, and the sum of the first angle θ11 and the second angle θ12 is substantially equal to 90 degrees. The second reference light beam 12*a*0(*r*12) has an initial direction substantially perpendicular to the axis a1-a1.

The second angle θ12 is a second boundary effective angle θm2 for the continuous reflective surface 30 of the reflector 3 capable of guiding the initial light beams 12*a*0 directly radiating from the radiating point 100 of the light source 1 not passing through lens assembly 2 with respect to the axis a1-a1. The first angle θ11 is less than or equal to 45 degrees or ranging from about 0 to 30 degrees. The second angle θ12 is less than 90 degrees or ranging from about 20 to 90 degrees.

The initial light beams 11*a*0 and 12*a*0, the first reference light beam 11*a*0(*r*11) and the second reference light beam 12*a*0(*r*12) substantially travel along the same direction.

Note that the second reference light beam 12*a*0(*r*12) traveling in the second direction r12 is not interfered by the first and second outer ends 210 and 220 of the lens assembly 2. That is to say, part of the second predetermined light beam 12*a*1 formed by the initial light beams 12*a*0 moving on the second position r12 encloses the lens assembly 2 therein, so that the structure of the first and second lens 21 and 22 of the lens assembly 2 is limited within the light paths formed by the second reference light beam 12*a*0(*r*12), or the initial light beams 11*a*0 directly radiating from the radiating point 100 and away from the rectangular profile of the light source 1 travel along a longitudinal direction of the longitudinal profile of the light source 1 to strike the reflector 3, so that the reflected light beams 11*a*01 are formed not to impinge upon the lens assembly 2.

Figure 3:
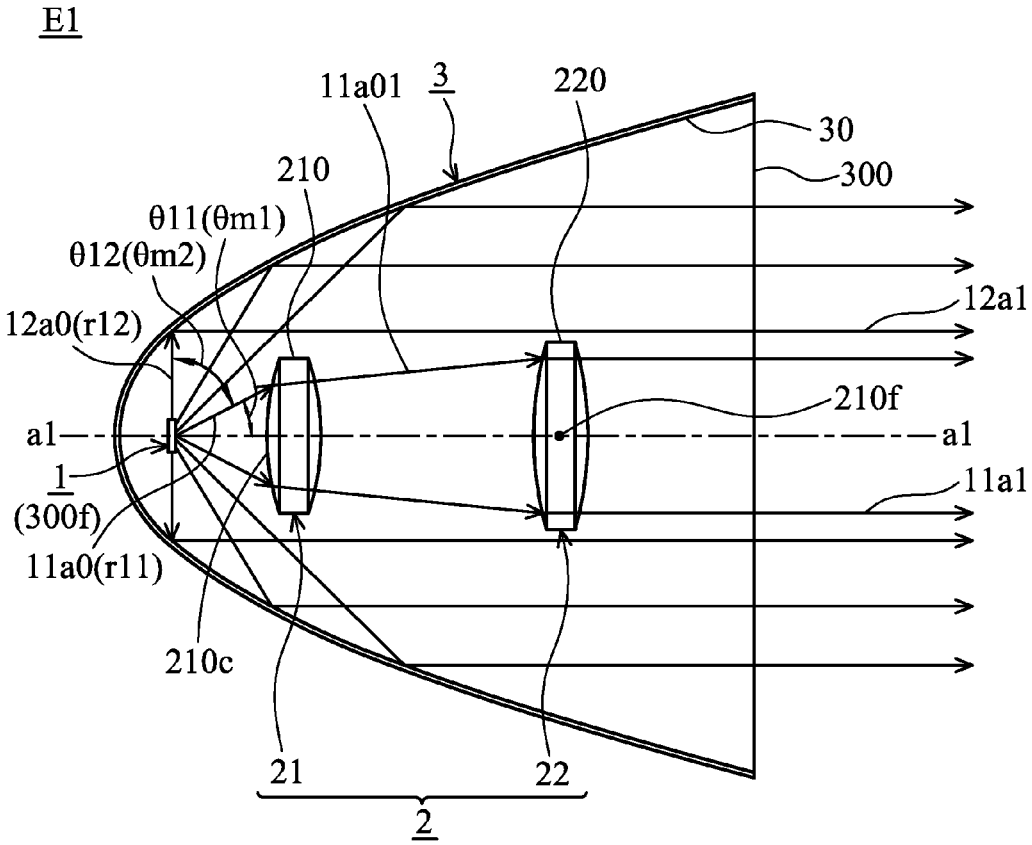
FIG. 3 is a schematic view of the projection illumination device (E1) in an operating mode.
Figure 4:
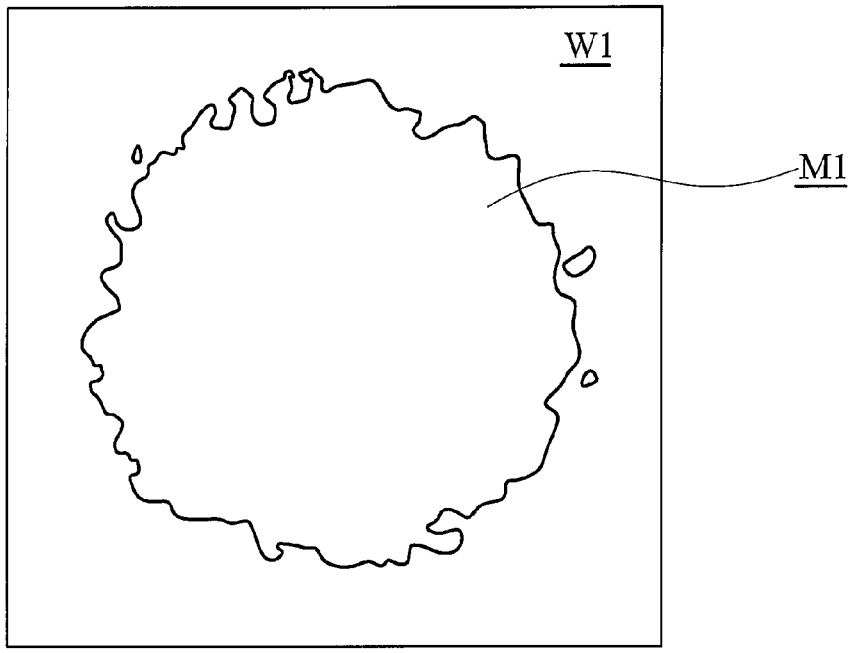
FIG. 4 is a schematic view of a projecting mode (M1) formed by the projection illumination device (E1)

In FIG. 3, the initial light beams 11*a*0 and 12*a*0 directly radiating from the radiating point of the light source 1 are guided by the lens assembly 2 and the reflector 3 to emit light in a desired projecting mode M1 (shown in FIG. 4) at a desired distance in front of the projection illumination device E1 according to related regulations. In this embodiment, the projecting mode M1 is a distant-light mode formed on a plane W1, at a predetermined distance, e.g., 25 meters in front of the projection illumination device E1.

Figure 5:
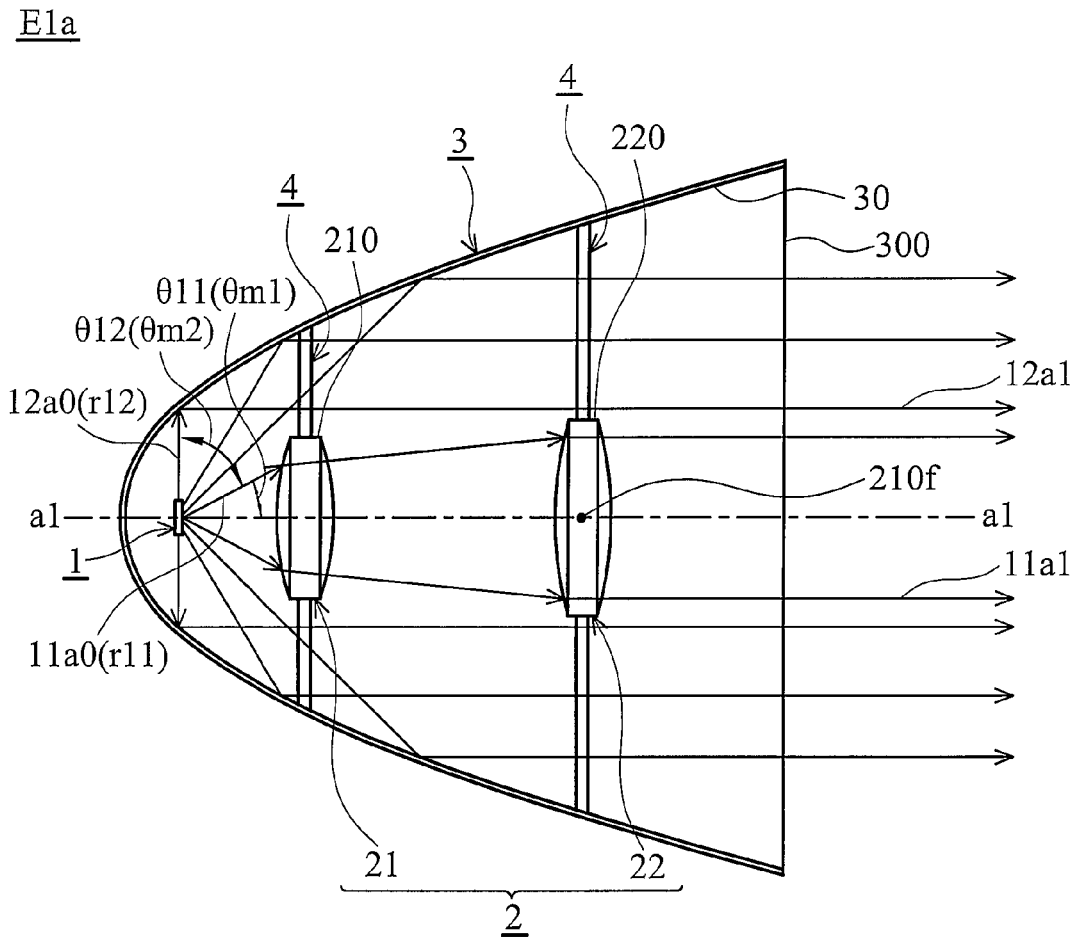
FIG. 5 is a schematic view of a varied example (E1*a*) of the projection illumination device (E1) of the invention.

In FIG. 5, a projection illumination device E1*a* is a varied example of the illumination device E1. The illumination device E1*a* differs from the projection illumination device E1 in that the projection illumination device E1*a* further comprises at least one connecting portion 4 disposed between the lens assembly 2 and the reflector 3, i.e., the lens assembly 2 is positioned on the reflector 3 via the connecting portion 4. In the projection illumination device E1*a*, two connecting portions 4 are applied to be disposed between the reflector 3 and the first lens unit 21 and between the reflector 3 and the second lens unit 22, respectively. The installation of the connecting portions 4 does not affect projecting mode M1. In other embodiments, the first and second lens units 21 and 22 of the lens assembly 2 are spherical or non-spherical lenses, and the continuous reflective surface 30 of the reflector 3 can be a parabolic surface or formed by multiple of curved surfaces.

Figure 6:
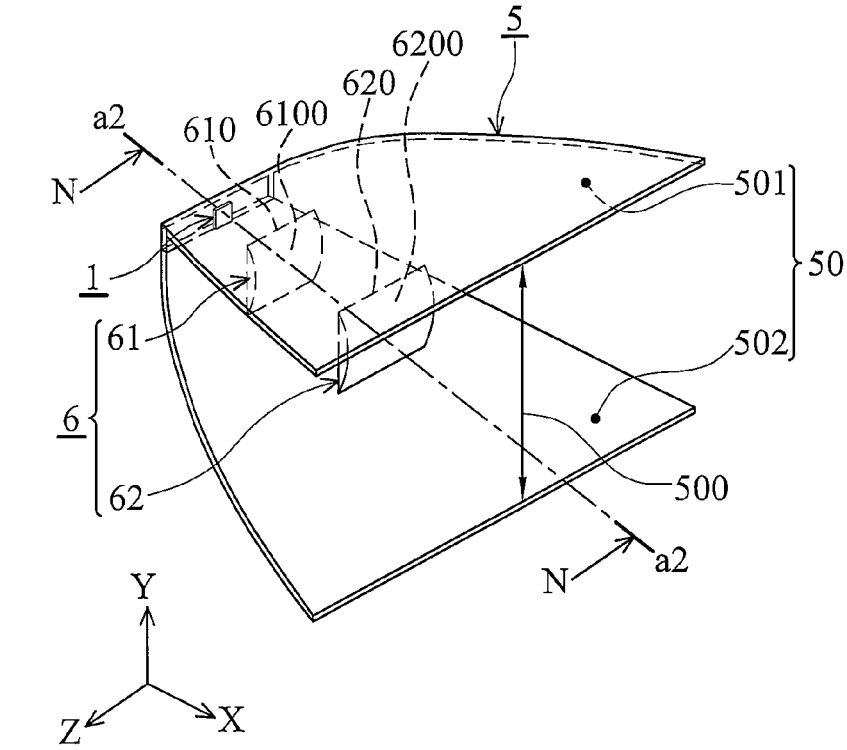
FIG. 6 is a schematic view of a projection illumination device (E2) of a second embodiment of the invention.
Figure 7A:
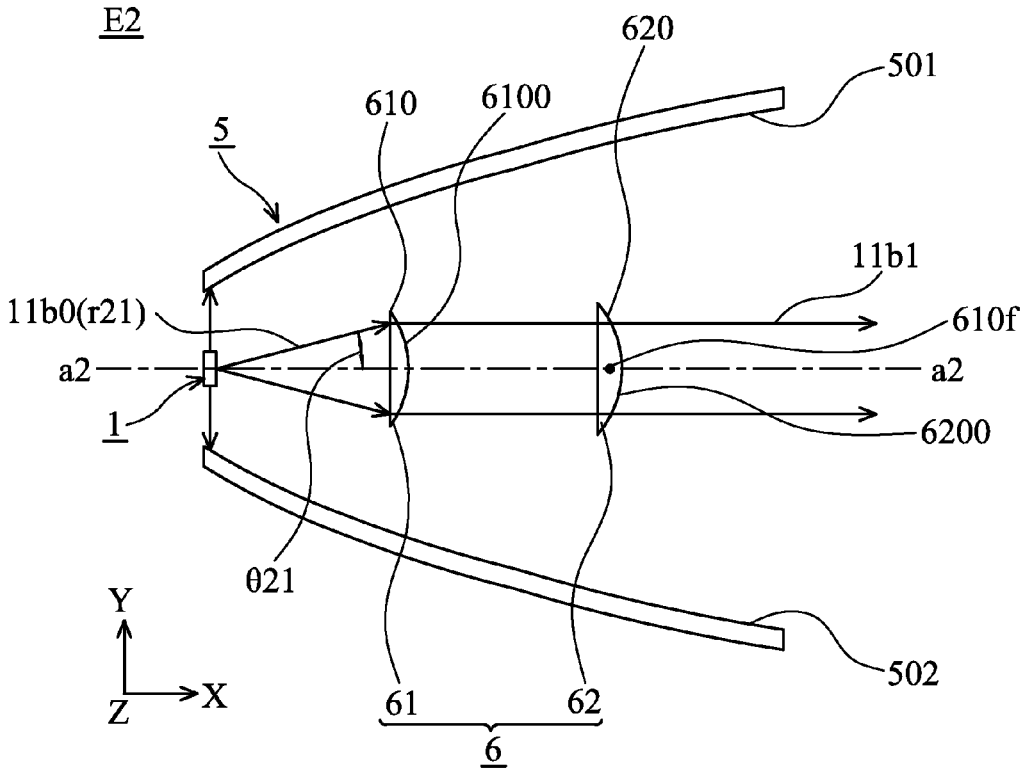
FIG. 7A is a schematic view of the projection illumination device (E2) in an operating mode.
Figure 7B:
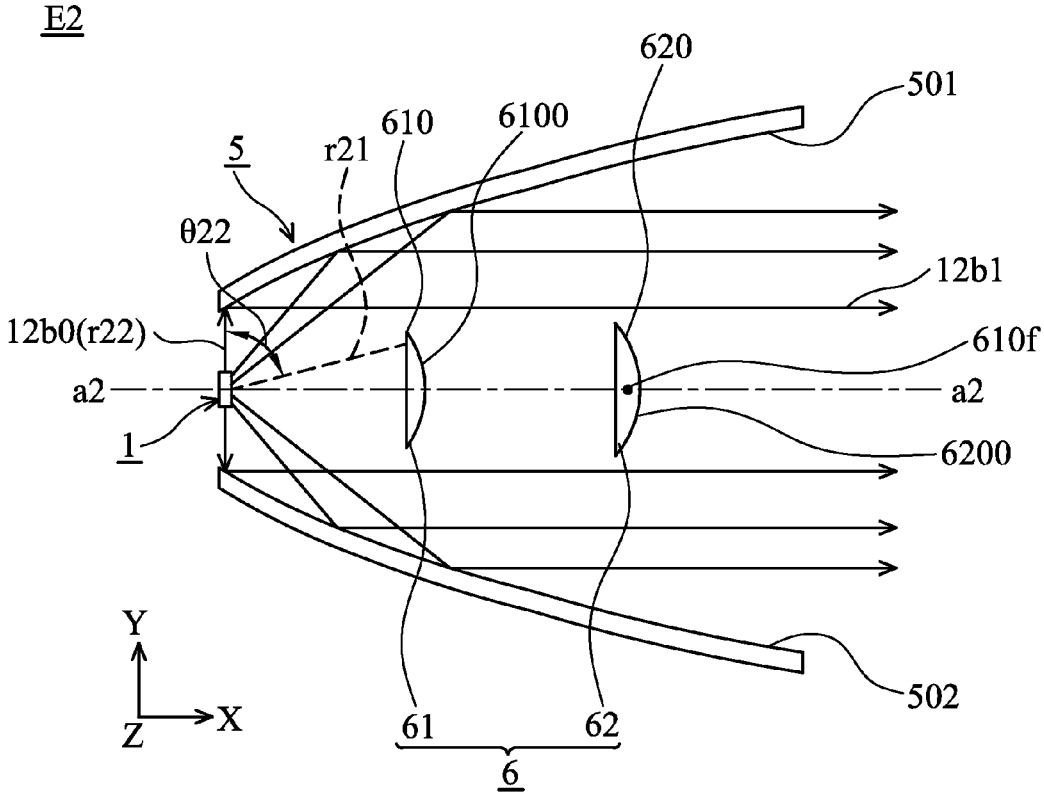
FIG. 7B is a schematic view of the projection illumination device (E2) in an operating mode.

In FIG. 6, a projection illumination device E2 of a second embodiment of the invention comprises the light source 1, a reflector 5 and a lens assembly 6. FIGS. 7A and 7B are two sectional views along an axis a2-a2 and a direction N-N of FIG. 6, respectively specifying two main parts of the light paths of the projection illumination device E2. The geometrical structure of projection illumination device E2 is defined by a three-dimensional, or XYZ, Cartesian coordinate system comprising three axes X, Y and Z. The axis a2-a2 is parallel to the axis X.

The light source 1 and the lens assembly 6 disposed in the reflector 5 along the axis a2-a2 are spaced from each other.

The reflector 5 comprises a reflective surface 50 having a first reflecting region 501 and a second reflecting region 502 and a light-emitting opening 500 formed on the edges of the first and second reflecting regions 501 and 502. The second reflecting region 502 is not connected to the first reflecting region 501, i.e., the reflector 5 is a device comprising a semi-opened structure. The shape of the light-emitting opening 500 is dependent on a curvature of the reflective surface 50.

A plurality of initial light beams 11*b*0 and 12*b*0 directly radiating from the radiating point of the light source 1 are guided by the reflector 5 and/or the lens assembly 6 to form a desired projecting mode, e.g. distant-light mode, except the initial light beams traveling along the axis Z. That is to say, the initial light beams traveling along the axis Z are directly emitted toward the remote. In this embodiment, the first and second reflecting regions 501 and 502 are cylindrical curved surfaces, and the two axes of the first and second reflecting regions 501 and 502 are formed by the parabolic lenses having the same curvature, thus, symmetrical light-emitting opening 500 is obtained. Conversely, if the two axes of the first and second reflecting regions 501 and 502 are formed by the parabolic lenses having two distinct curvatures, the profile of the light-emitting opening of the reflector 5 is asymmetrical (not shown in Figs.).

The lens assembly 6 comprises a first lens unit 61 having a first focus 610*f* and a second lens unit 62 substantially located at the first focus 610*f* of the first lens unit 61. The first and second lens unit 61 and 62 are disposed apart from each other on the axis a2-a2, and the first lens unit 61 is disposed between the light source 1 and the second lens unit 62. The first lens unit 61 comprises a first cylindrical lens 6100 and the second lens unit 62 comprises a second cylindrical lens 6200. The first and second cylindrical lenses 6100 and 6200 of the first and second lens units 61 and 62 sequentially guide the initial light beams 11*b*0 directly radiating from the radiating point 100 of the light source 1 to form a first predetermined light beam 11*b*1 traveling toward the remote.

With respect to an effective area of the first lens unit 61, conical initial light beams 11*b*0 directly radiating from the radiating point of the light source 1 received by the first lens unit 61 are guided to the second lens unit 62. The outer conical surface of the conical initial light beams 11*b*0 is defined as a first position r21, and a first angle θ21 is substantially formed between the first position r21 and the axis a2-a2. The initial light beams 11*b*0 located on the first position r21 are defined as a first reference light beam 11*b*0(*r*21) traveling on the first position r21. That is to say, the first angle θ21 is a first boundary effective angle θn1 for the lens assembly 2 capable of guiding the initial light beams 11*b*0 directly radiating from the radiating point of the light source 1 with respect to the axis a2-a2.

The initial light beams 11*b*0 located inside the first position r21 and the first reference light beam 11*b*0(*r*21) located on the first position r21, i.e., the initial light beams 11*b*0 located in the range of the first angle θ21 with respect to the axis a2-a2, are converted into a plurality of refracted light beams 11*b*01 by the first lens unit 61, and the refracted light beams 11*b*01 guided by the second lens unit 62 forms the first predetermined light beam 11*b*1 traveling away from the light source 1.

In FIG. 7B, to specify the distribution of the light beams reflected by the reflective surface 50 of the reflector 5, the initial light beams 11*b*0 located within the first position r21 guided by the first and second lens 61 and 62 of the lens assembly 6 and the first predetermined light beam 11*b*1 formed by the first and second lens 61 and 62 are omitted.

The initial light beams 12*b*0 directly radiating from the radiating point of the light source 1 perpendicular to the axis a2-a2 is reflected by the reflective surface 50 of the reflector 5 to form a second predetermined light beam 12*b*1 traveling away from the light source 1. The second predetermined light beam 12*b*1 substantially has a round structure defined as a second position r22, and a second angle θ22 is substantially formed between the second position r22 and the first position r21. The initial light beams 12*b*0 located on the second position r22 are defined as a second reference light beam 12*b*0 (*r*22) traveling on the second position r22. In this embodiment, the first angle θ21 is less than or equal to the second angle θ22, and the sum of the first angle θ21 and the second angle θ22 is substantially equal to 90 degrees. The second reference light beam 12*b*0(*r*22) has an initial direction substantially perpendicular to the axis a2-a2.

The second angle θ22 is a second boundary effective angle θn2 for the reflective surface 50 of the reflector 5 capable of guiding the initial light beams 12*a*0 radiating from the radiating point of the light source 1 not passing through lens assembly 6 with respect to the axis a2-a2. The first angle θ21 is less than or equal to 45 degrees or ranging from about 0 to 30 degrees. The second angle θ22 is less than 90 degrees or ranging from about 20 to 90 degrees.

Note that the first and second outer ends 610 and 620 of the lens assembly 6 do not interfere with the second reference light beam 12*b*0(*r*22) traveling on the second position r22. That is to say, the structure of the first and second lens units 61 and 62 of the lens assembly 6 is limited within the light paths formed by the second reference light beam 12*b*0(*r*22).

Figure 8:
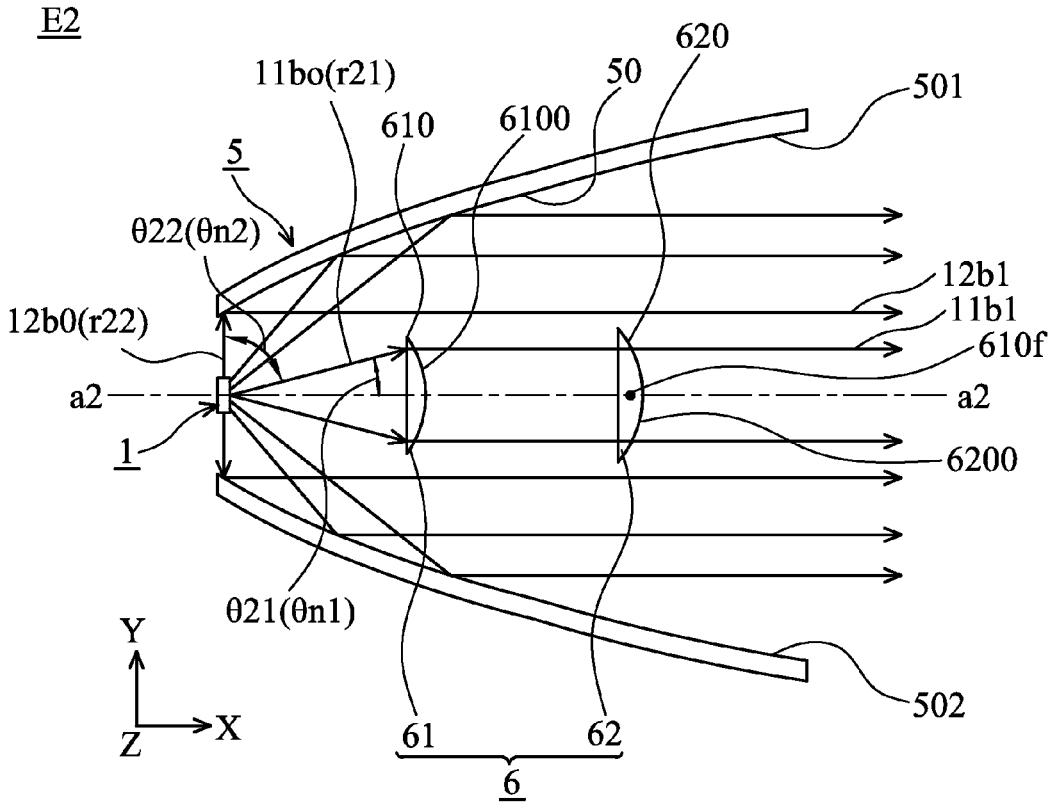
FIG. 8 is a schematic view of the projection illumination device (E2) in an operating mode.
Figure 9:
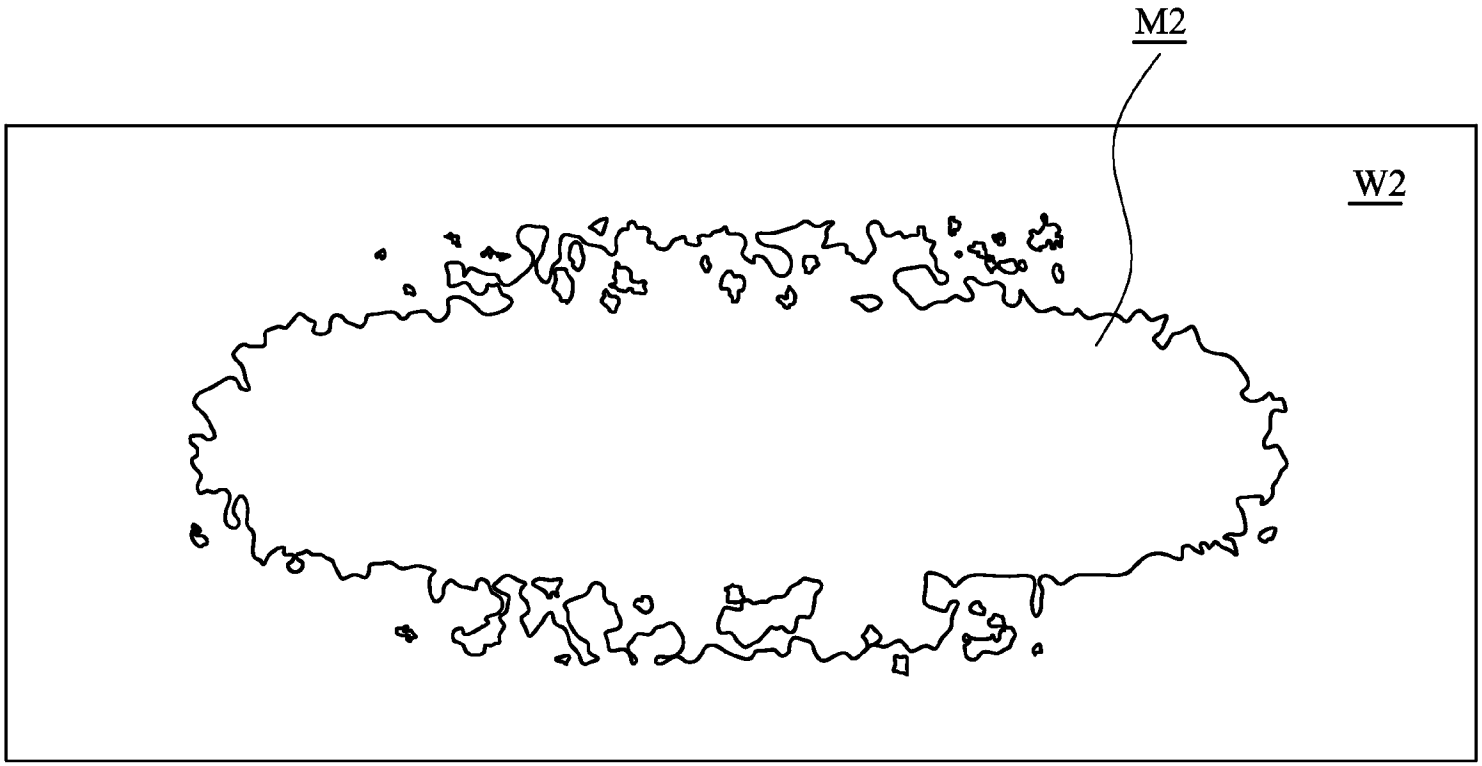
FIG. 9 is a schematic view of a projecting mode (M2) formed by the projection illumination device (E1).

In FIG. 8, the initial light beams 11*b*0 and 12*b*0 radiating from the radiating point of the light source 1 are guided by the lens assembly 6 and the reflector 5 to form a desired projecting mode M2 (shown in FIG. 9) at a desired distance in front of the projection illumination device E2 according to the related regulations. In this embodiment, the projecting mode M2 is a signal-light mode or signal formed on a plane W2, at a predetermined distance, e.g., 25 meters, away from the projection illumination device E2.

In addition, the connecting portion 4 can be disposed between the reflector 5 and the lens assembly 6 (not shown in Figs.).

In other embodiments, the first and second lens units 61 and 62 of the lens assembly 6 are spherical or non-spherical lenses, and the reflective surface 50 of the reflector 5 can be a cylindrical surface having a parabolic or other curvature.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A projection illumination device, comprising:

a light source disposed on an axis and transversely crossing the axis at a radiating point thereof, wherein the axis is an optical axis;

a lens assembly disposed on the axis, comprising at least two biconvex lenses comprising a front convex side facing the light source, a vertical assist line passing through the radiating point of the light source and utilized to geometrically define the light source and the lens assembly being composed of a first line segment and a second line segment vertically intersected with the first line segment at a corner point, wherein the first line segment is perpendicular to the axis and passes through the radiating point of the light source, and the second line segment is parallel to the axis and tangent to an outermost end of the lens assembly with respect to the axis; and a reflector comprising a continuous reflective surface disposed on the axis and concave to the front convex side of the at least two biconvex lenses of the lens assembly to enclose the lens assembly therein, the corner point of the vertical assist line being located within the reflector, wherein the light source is disposed between the continuous reflective surface of the reflector and the front convex side of the at least two biconvex lenses of the lens assembly, and wherein the light source, the lens assembly and the reflector are arranged such that initial light beams directly radiating to the front convex side of the at least two biconvex lenses without being subject to reflection by the continuous reflective surface of the reflector become refracted light beams traveling parallel to the axis, and initial light beams directly radiating from the radiating point of the light source and reflected by the continuous reflective surface of the reflector become reflected light beams traveling parallel to the axis, wherein the reflected light beams do not impinge upon the lens assembly.

2. The projection illumination device of claim 1, wherein the light source, the lens assembly and the reflector are arranged such that the lens assembly is encompassed by reflected light beams reflected from initial lights beams radiated in a direction which is passing through the radiating point of the light source and perpendicular to the axis.

3. The projection illumination device of claim 1, wherein the at least two biconvex lenses are on the axis and not overlapped with each other in a direction perpendicular to the axis.

4. The projection illumination device as claimed in claim 1, wherein the at least two biconvex lenses are not embedded with each other.

5. The projection illumination device as claimed in claim 1, wherein the at least two biconvex lenses are spherical lenses.

6. A projection illumination device, comprising:

a light source disposed on an axis, wherein the axis is an optical axis;

a lens assembly disposed on the axis, comprising a first lens unit having a first focus and a second lens unit substantially located at the first focus of the first lens unit, and the first lens unit is located between the light source and the second lens unit; and a reflector comprising a reflective surface concave to the first and second lens units of the lens assembly;

wherein the first and second lens units are on the axis and not overlapped with each other in a direction perpendicular to the axis;

wherein the light source disposed on the axis is transversely crossing the axis at a radiating point thereof to generate a plurality initial light beams traveling in a direction of the axis toward the lens assembly, in a direction perpendicular to the axis, and therebetween;

wherein the lens assembly disposed on the axis comprises a front convex side facing the light source, wherein the front convex side of the lens assembly is arranged to guide the plurality of initial light beams directly radiating from the radiating point of the light source and incident to the front convex side of the lens assembly without reflection by the reflector to form a first predetermined light beam traveling away from the radiating point of the light source; and wherein the reflector comprises a continuous reflective surface concave to the front convex side of the lens assembly, and wherein the continuous reflective surface of the reflector is arranged to guide the plurality of initial light beams directly radiating from the radiating point of the light source and not incident to the lens assembly to form a second predetermined light beam traveling away from the radiating point of the light source, wherein the second predetermined light beam encloses the lens assembly without impinging thereon.

7. The projection illumination device as claimed in claim 6, wherein the continuous reflective surface comprises a parabolic surface.

8. The projection illumination device as claimed in claim 6, wherein the first lens unit comprises a first cylindrical lens and the second lens unit comprises a second cylindrical lens.

9. The projection illumination device as claimed in claim 6 further comprising at least one connecting portion disposed between the lens assembly and the reflector.

10. The projection illumination device as claimed in claim 6, wherein the plurality of initial light beams are guided by the lens assembly and the reflector to form a projecting mode, and the projecting mode comprises an indicator mode or a signal light mode.

11. The projection illumination device as claimed in claim 6, wherein the reflector further comprises a light-emitting opening, and the shape of the light-emitting opening is dependent on a curvature of the reflector.

12. The projection illumination device as claimed in claim 6, wherein an angle between the axis and an outer end of the lens assembly, and having a vertex at the radiating point, is less than or equal to 45 degrees.

13. The projection illumination device as claimed in claim 6, wherein an angle between the axis and an outer end of the lens assembly, and having a vertex at the radiating point, is less than or equal to 30 degrees.

14. A projection illumination device, comprising:

a light source disposed on an axis, wherein the axis is an optical axis;

a lens assembly disposed on the axis, comprising a first lens unit having a first focus and a second lens unit substantially located at the first focus of the first lens unit, and the first lens unit is located between the light source and the second lens unit; and a reflector comprising a reflective surface concave to the first and second lens units of the lens assembly;

wherein the first and second lens units are on the axis and not overlapped with each other in a direction perpendicular to the axis;

wherein the light source disposed on the axis is transversely crossing the axis at a radiating point thereof to generate a plurality initial light beams traveling in a direction of the axis, a direction perpendicular to the axis, and therebetween;

wherein the lens assembly further comprises a front side facing the light source and an outer end, and the front side of the lens assembly arranged to guide the plurality of initial light beams radiating from the radiating point of the light source within a first angle ranged from the axis to the outer end with respect to the radiating point of the light source so as to be incident to the front side of the lens assembly to form a first predetermined light beam traveling away from the radiating point of the light source; and wherein the reflective surface of the reflector comprises a first reflecting region and a second reflecting region relatively disposed with respect to the axis to enclose the lens assembly therebetween, wherein the first and second reflecting regions of the reflective surface of the reflector are physically separated and arranged to guide the plurality of initial light beams radiating from the radiating point of the light source outside of the first angle to form a second predetermined light beam traveling away from the radiating point of the light source, wherein the second predetermined light beam encloses the lens assembly without impinging thereon.

* * * * *